US005135165A

United States Patent [19]

Greenhow

[11] Patent Number: 5,135,165

[45] Date of Patent: Aug. 4, 1992

[54] DEVICE FOR ALIGNING AND CLAMPING A RAIL

[75] Inventor: David Greenhow, Hamilton, Canada

[73] Assignee: Gantrex Limited, Don Mills, Canada

[21] Appl. No.: 696,946

[22] Filed: May 8, 1991

[51] Int. Cl.[5] ..... E01B 9/30

[52] U.S. Cl. ..... 238/341; 238/338

[58] Field of Search ..... 238/310, 338, 341, 347

[56] References Cited

U.S. PATENT DOCUMENTS

| | | | |
|---|---|---|---|
| 297,661 | 4/1884 | Barr . | |
| 1,230,630 | 6/1917 | Traut | 238/341 X |
| 1,252,971 | 1/1918 | Vasdahl | 238/341 |
| 1,470,090 | 10/1923 | Manning . | |
| 1,530,008 | 3/1925 | Muckley . | |
| 1,690,979 | 11/1928 | Johnson . | |
| 1,814,239 | 7/1931 | Buckbee . | |
| 2,051,982 | 8/1936 | Boyd et al. | 238/304 |
| 2,134,082 | 10/1938 | Goodrich | 238/341 |
| 2,168,324 | 8/1939 | Case | 238/341 |
| 2,258,964 | 10/1941 | Wood et al. | 238/341 |
| 2,319,862 | 5/1943 | Heald, Jr. | 238/341 |
| 3,028,099 | 4/1962 | Molyneux | 238/341 X |
| 3,934,800 | 1/1976 | Molyneux | 238/341 |
| 4,179,067 | 12/1979 | Baier | 238/91 |
| 4,193,544 | 3/1980 | Marchant et al. | 238/347 |
| 4,494,695 | 1/1985 | Sonneville | 238/265 |
| 4,566,629 | 1/1986 | Sonneville | 238/117 |
| 4,802,624 | 2/1989 | Marchant | 238/317 |

FOREIGN PATENT DOCUMENTS

| | | | |
|---|---|---|---|
| 250844 | 10/1987 | Fed. Rep. of Germany | 238/341 |
| 771231 | 10/1980 | U.S.S.R. | 238/338 |

OTHER PUBLICATIONS

Holdfast "Soft" Clip brochure (undated).
"True Cam" Clip brochure (undated).
Gantrex Clip 3120/15 brochure (Nov. 1988).

*Primary Examiner*—David A. Bucci
*Assistant Examiner*—Robert S. Katz
*Attorney, Agent, or Firm*—Ridout & Maybee

[57] ABSTRACT

A rail clamping device is provided for aligning and clamping the flange of a rail to a support surface. A slotted clip is fitted over an anchor bolt or other suitable connector, a plate cam washer having an eccentric hole is placed upon the clip, and a nut threaded upon the bolt to secure the clip and washer to the rail flange. The clip has a slotted base portion which slidably engages the support surface in a loose condition and bears upon the support surface in a clamped condition. An abutment portion extends from the base perpendicular to the support surface to engage the outer face of the rail flange. A cantilever portion extends forwardly from the abutment portion and has a bottom surface to which a synthetic rubber strip is bonded to engage the upper surface of the flange to clamp the flange to the supporting surface. The cam washer slidably engages the top surface of the base portion in a loose condition. The cam washer has an outer flank for engaging a rearward face of the abutment portion. Preferably, the cam washer has a spiral cam profile such that the angular rotation of the washer upon the bolt results in substantially proportional lateral movement of the clip and abutting rail flange. The rail flange may be aligned by rotation of the cam washers of devices on opposing sides of the rail when in a loose condition and then clamped securely in place by rotation of the nut.

19 Claims, 5 Drawing Sheets

DEVICE FOR ALIGNING AND CLAMPING A RAIL

TECHNICAL FIELD

The present invention relates to a device for aligning and clamping a rail flange upon a supporting surface.

BACKGROUND ART

Various types of travelling machinery such as cranes and gantries require accurately aligned rail supports for their proper operation. Rails which are not parallel or straight within acceptable tolerances lead to the shifting out of square of the travelling machine's frame, and to excessive wearing of rails and wheels. Due to the vibration caused by moving machinery, impact loads exerted upon the rails, and settlement or shifting of supporting structures, the rails may move out of accurate alignment. Periodic maintenance is required to check the alignment of rails and take corrective action to prevent damage or premature wear.

In order to enable accurate periodic realignment and initial alignment of rails, adjustable connecting devices have been developed. Generally, a rail is laid between opposing rows of connectors spaced at regular intervals along the length of the rail. The connectors are arranged in opposing pairs each clamping one side of the flange to the supporting surface. The spacing of the connector pairs is determined by the prevailing loads, the rail capacity and connector capacity.

Commonly, the connectors comprise a rail clip having an oversized or slotted hole through which a bolt passes. The clips have a forward portion extending over the rearward portion of the flange's top surface to engage and secure the flange in position. The bolt is fixed to the supporting surface at its lower end and has a threaded upper end to receive a mating nut and lock washer. When in a clamped condition, the clip is locked to the supporting surface by the nut and lock washer. A bearing-type connection is commonly used, wherein the design load capacity is determined by bearing between the bolt, washer and clip, rather than a friction-type connection. When in a loose condition, the nut is withdrawn upwardly and the clip is free to slide forwardly and rearwardly to the extent allowed by the bolt within the oversized or slotted hole. Between the bottom surface of the flange and the supporting surface, a resilient pad may be placed to reduce the effects of impact and vibration. Bolts of various types may be used depending upon the nature of the supporting surface, for example: a headed through-bolt or stud-welded bolt may be used where the supporting surface is the flange of a steel runway beam; and an anchor bolt may be embedded in a concrete supporting surface.

Two types of conventional connectors are described in U.S. Pat. No. 2,134,082 to Goodrich. In both cases, a clip is mounted to a bolt through a round hole nominally sized to suit the bolt diameter with clearance. Between the clip and supporting surface is a plate which abuts the outer face of the flange. In one case, the plate is rectangular having a diagonal slot through which the bolt passes. The rail flange may be laterally moved by tapping upon the transverse ends of the plate whereby the bolt engaging the diagonal slot forces the plate forwardly and rearwardly. The outer face of the flange, in transmitting lateral loads to the securing bolts, may bear upon the full forward face of the rectangular plate. In the second case described in U.S. Pat. No. 2,134,082, the abutting plate and clip have circular mutually registering holes. The plate has a symmetrical forward face of varying radial curvature centred about the hole in the plate such that rotation of the plate about the bolt results in a lateral shifting of the rail flange. In the second case, the outer face of the flange bears upon a small curved area on forward face of the curved plate. When the clip is securely clamped with the nut, the lateral loads from the rail are transmitted to the bolt mainly through friction between the forward portion of the clip and the top surface of the flange. Through vibration and impact due to the moving machinery, the nut often loosens and in the second case described, concentrated loads bear upon the forward face of the curved plate. These concentrated loads may exceed the bearing capacity of the curved plate or flange resulting in indentations which tend to act as stress concentrators in initiating fatigue failure. In addition, the rail and curved plate may wear excessively in the area of bearing necessitating replacement. In the first case, the rectangular plate more evenly distributes the bearing stresses, however the space required to accommodate the rectangular plate between its extreme forward and rearward positions may be considered excessive in some applications.

More compact connectors are described in U.S. Pat. No. 1,470,090 to Manning and U.S. Pat. No. 3,934,800 to Molyneux. The clips of these connectors have an oversized central hole with a countersunken circular upper portion which accommodates a circular washer. The washer has an offset eccentric hole nominally sized to suit the bolt which passes through it. The clip has a forward portion which engages the top surface of the flange and has an abutting shoulder portion rearward of the forward portion to engage the outer surface of the flange. The abutting shoulder evenly distributes the lateral bearing loads from the rail. Rotation of the washer about the bolt in a loose condition causes the circular peripheral surface of the washer to slide upon the interior circular surface of the countersunken upper portion of the clip's central hole. Therefore, rotation of the washer causes the clip to shift forwardly and rearwardly to align the rail flange due to the eccentricity of the hole in the washer. Such circular eccentric washers are relatively easy to manufacture, however, considerable mechanical disadvantages result through their use. When such a clip is at its rearwardmost or at its forwardmost position, and the distance between the eccentric hole and the forward portion of the clip is at a minimum or maximum, rotation of the washer through a fixed angular increment results in a relatively large lateral movement of the clip. In these positions therefore, the connector has poor sensitivity since a small rotation results in a large displacement of the clip. The mechanical advantage is also poor in that a large torque needs to be applied in order to displace the clip and rail against a given resisting force. When the clip is at an intermediate position, rotation of the washer through the same fixed angular increment results in a relatively small lateral movement of the clip. In this position the connector has increased sensitivity since a relatively large rotation of the washer is required to displace the clip a given amount, but the torque needed to displace the clip and rail against a given resisting force is smaller.

The alignment operation using such conventional connectors is complicated by the washer's varying sensitivity and responsiveness regarding lateral movement and angular position. The varying effort required and sensitivity make the alignment operation one of trial and error for all practical purposes since it is difficult to predict the correspondence between the torque applied and the resulting lateral movement A further problem with these connectors is that it is easy to install them in an incorrect orientation in which tightening of a nut on the bolt rotates the washer in a sense which tends to loosen the clip.

It is desirable therefor, to provide a connector which has a sufficient bearing area to eliminate the problems associated with concentrated loads and that is easy to install and adjust correctly.

DISCLOSURE OF THE INVENTION

The present invention provides a connector device which addresses the disadvantages of conventional connectors in a novel manner.

In accordance with the invention a device is provided for aligning and clamping a flange upon a supporting surface, including: a clip, having a base portion, an abutment portion and a cantilever portion. The base portion has a longitudinal slot and has a bottom surface slidably engaging the support surface in a loose condition and bearing upon the support surface in a clamped condition. The abutment portion extends from a forward end of the base portion perpendicular to the supporting surface. The abutment portion has a forward face for engaging an outer face of the flange. The cantilever portion extends forwardly from the abutment portion, and has a bottom surface engaging an upper surface of the flange. A cam washer is included having a round hole eccentrically located. The cam washer has a bottom surface slidably engaging a top surface of the base portion when in a loose condition and bearing upon the base portion in a clamped condition. The cam washer has an outer flank for engaging a rearward face of the abutment portion. Connecting means engage a top surface of the cam washer and extend through the hole and the base slot for aligning and bearing upon the cam washer and clip to the supporting surface and for clamping the flange between the cantilever portion and the supporting surface.

In a manner described below in detail, the flange may be aligned by rotating the cam washer about the connecting means in a loose condition.

BRIEF DESCRIPTION OF THE DRAWINGS

In order that the invention be readily understood, embodiments will be described by way of examples with reference to the accompanying drawings.

BEST MODE OF CARRYING OUT THE INVENTION

Figure 1:
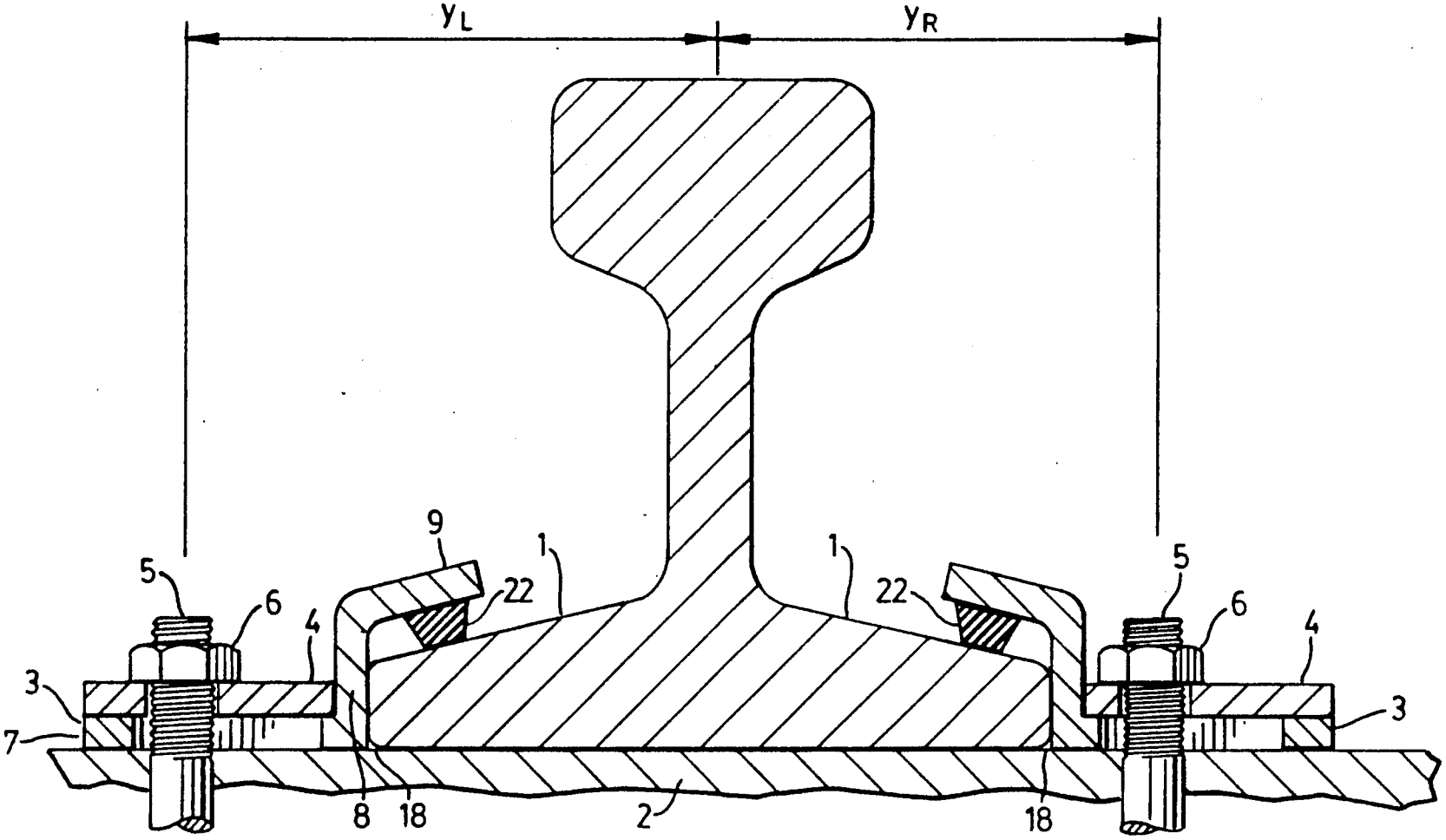
FIG. 1 is a sectional view of two connectors clamped to both sides of a rail flange.
Figure 3:
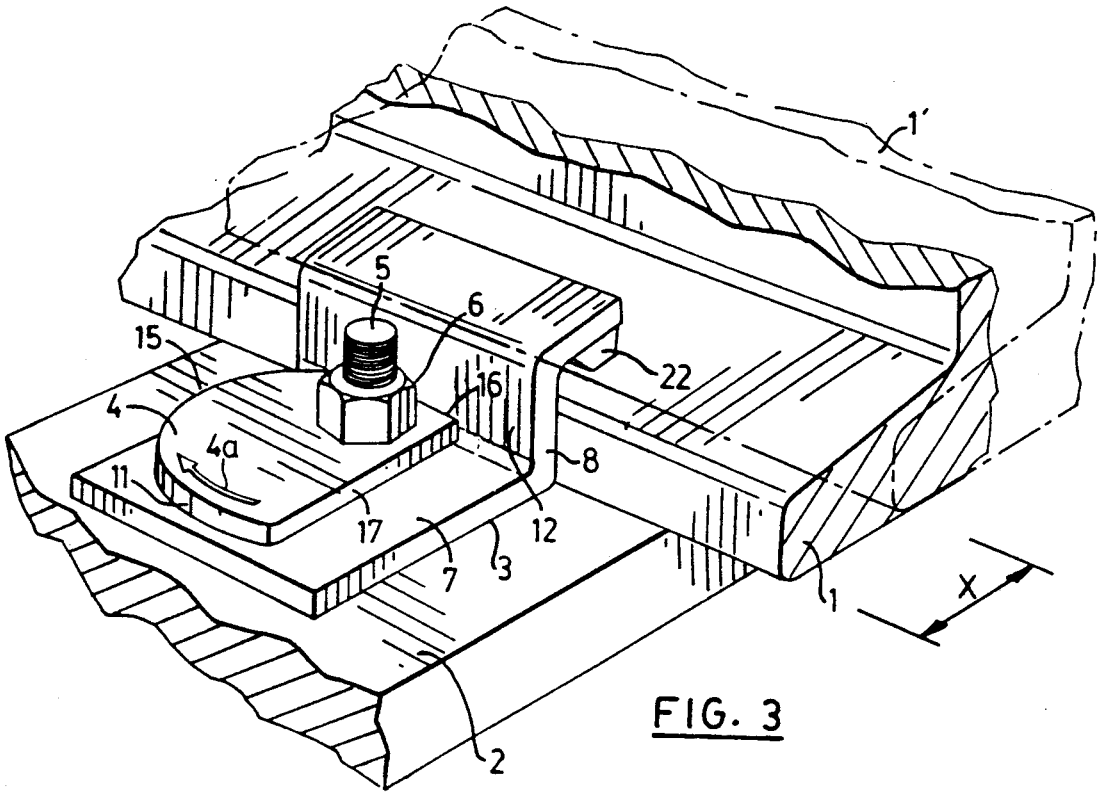
FIGS. 3 and 4 are isometric views of connectors including cam washers showing the clips respectively in their extreme rearward and forward positions.
Figure 4:
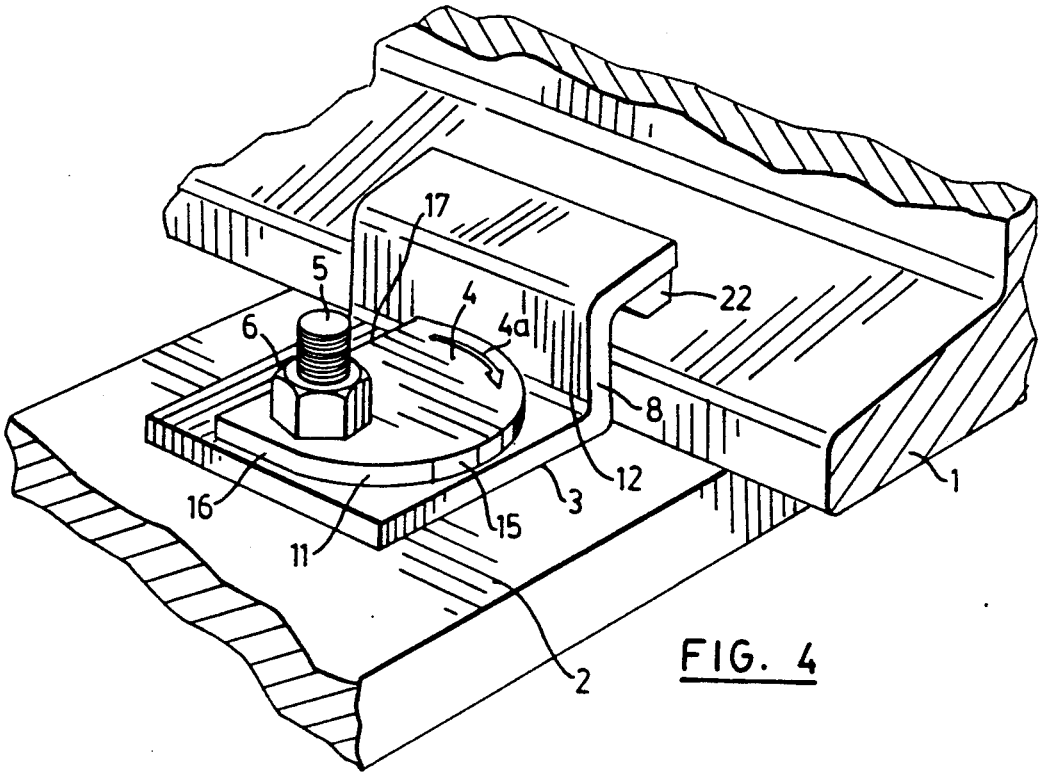

With reference to FIGS. 3 and 4, the general functioning of a connector in accordance with the invention is shown. A rail flange 1 is supported upon a supporting surface 2. In FIG. 3, the flange 1 is shown in its rearwardmost position in solid lines and in its forwardmost position in dashed outline as 1' with dimension "x" indicating the maximum extent of lateral adjustment. In FIG. 4, the flange is shown in its forwardmost position. The connector includes a clip 3 having a longitudinal slot, a cam washer 4, a bolt 5 and nut 6. When in a loose condition, the nut 6 is slackened and the washer 4 may be rotated about the bolt 5. As the washer 4 is rotated clockwise, the outer flank of the washer engaging the clip 3 urges the clip 3 and abutting rail 1 forwardly to align the rail. As shown in FIG. 1, a like connector is positioned on the opposite side of the rail flange 1. By rotating the washers 4 of the opposing pair of connectors in opposite rotational directions, the flange 1 may be laterally aligned. When the flange 1 is in its desired location, the nuts 6 are tightened to clamp the flange 1 in position. The nuts 6 have right hand threads. Thus, with the washer 4 oriented as shown, tightening of the nuts 6 on the bolts 5 tends to rotate the washers 4 clockwise due to friction between the nut 6 and washer 4 thereby further securing the washer 4 in engagement with the clip 3.

Preferably, the washer 4 carries indicia readily enabling one face to be distinguished from the other, so that the installer is guided to install the washer in the correct orientation as shown in FIGS. 3 and 4. Preferably the indicia are on the one face which is properly to be installed uppermost, so that on clockwise rotation the width of the washer relative to a fixed point increases progressively. Such indicia may advantageously be in the form of an arrow 4*a* indented in said one face and pointing in the direction of clockwise rotation about a hole 4*b* in the washer 4.

Figure 2:
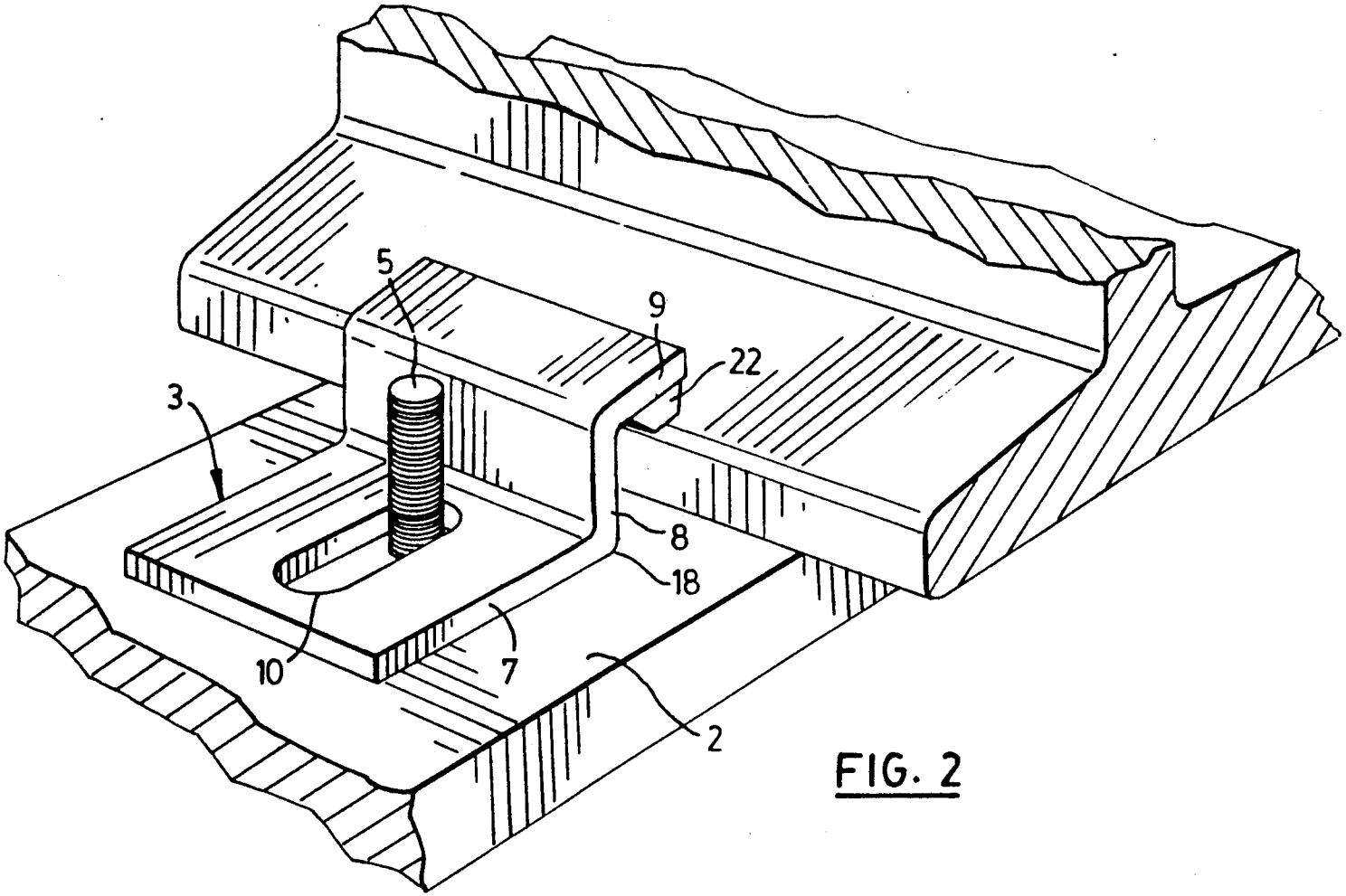
FIG. 2 is an isometric view of a clip having a slotted hole mounted upon a bolt adjacent a rail flange.

As shown in FIGS. 1 and 2, the clip 3 has a base portion 7, an abutment portion 8 and a cantilever portion 9. The base portion 7 has a longitudinal slot 10 through which the bolt 5 projects. The abutment portion 8 extends from the forward end of the base portion 7 perpendicular to the supporting surface 2. The cantilever portion 9 extends forwardly from the abutment portion 8.

During installation of the rail and connectors, a series of bolts 5 are secured to the supporting surface by conventional methods. Bolts 5 may be: a stud-welded bolt upon a metal supporting surface; a headed bolt passing through a hole in a supporting plate surface; or an anchor bolt embedded in a concrete supporting surface. The centre line of the desired rail location is determined and the bolts 5 are longitudinally spaced in opposing pairs each at a specified lateral distance from the centre line of rail. The lateral distance, dimensions $y_L$ or $y_R$ in FIG. 1, is determined primarily by the width of the flange 1 and the length of slot 10 chosen. The length of the slot 10 is selected to provide the desired degree of lateral alignment and to compensate for any inaccuracy in the installation of the bolts 5.

The rail is positioned between the opposing bolts in its approximate desired location and the clips 3 are placed upon the bolts 5 which project through the slots 10 as shown in FIG. 2. The clip 3 is moved in loose engagement with the flange 1 as best illustrated in FIG. 1. If desired an impact absorbing elastomeric mat (not shown) may be laid between the supporting surface 2 and the bottom surface of the flange 1 in which case the height of the abutment portion 8 is extended to allow for the thickness of the mat. An impact absorbing elastomeric pad 22 is included bonded to the bottom surface of the cantilever portion 9. The forward face of the abutment portion 8 engages the outer face of the flange 1 and the bottom surface of the elastomeric pad 22 engages the upper surface of the flange 1. The bottom surface of the base portion 7 slidingly engages the support surface 2 when the nut 6 is not tightened and the connector is in a loose condition.

The cam washer 4 has its circular hole 4*b* eccentrically located, through which the bolt 5 projects when the cam washer 4 is placed upon the top surface of the clip base portion 7. The nut 6 is then threaded upon the bolt 5 to secure the washer 4 and clip 3 in a loose condition as shown in FIG. 3. The bottom surface of the cam washer 4 slidably engages the top surface of the base portion 7 in a loose condition. The outer flank 11 of the cam washer 4 engages the rearward face 12 of the abutment portion 8. The flank 11 has a particularly advantageous cam profile and the abutment rearward face 12 follows the cam profile when engaging the flank 11 as the cam washer 4 is rotated.

Referring to FIGS. 3 and 4, the rail flange 1 may be laterally shifted to the extent indicated by the dimension x. Dimension x is determined by the geometry and dimensions of the cam washer 4 and not by the length of the slot 10. That is to say when the clip 3 is in the forwardmost position, the bolt 5 is spaced from the rearward end of the slot 10, and in the rearwardmost position, the bolt 5 is spaced from the forward end of the slot 10. It will be apparent that the slot 10 need not be longitudinally parallel to the direction of lateral flange motion since a diagonal slot 10 may also be used for example as in the prior art.

Figure 5:
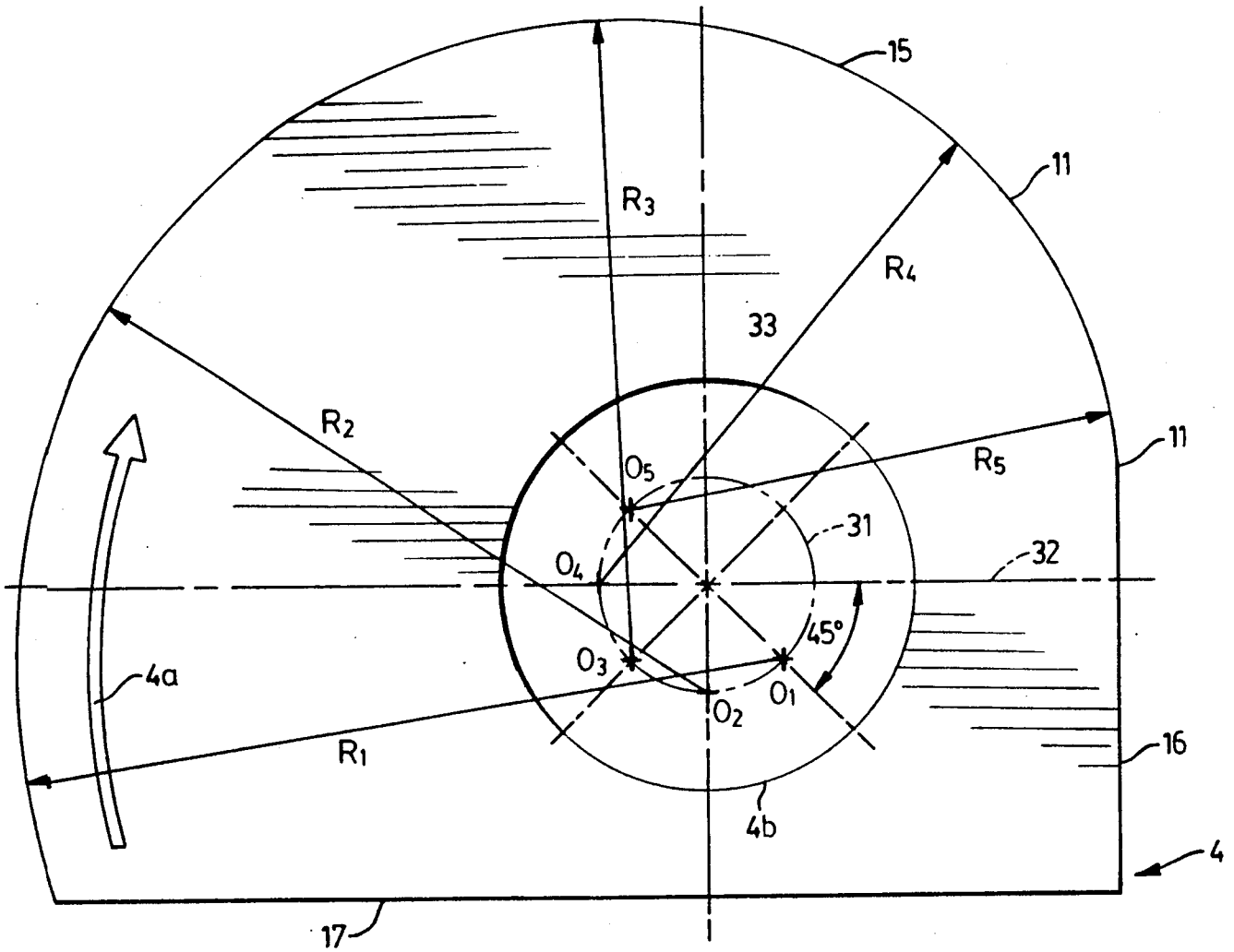
FIG. 5 is a detail plan view of a cam washer having approximately 200° of rotational adjustment capability.

One example of a preferred cam profile is shown in relation to the cam washer 4 of FIG. 5. The circular hole 4*b* through which the bolt 5 projects is nominally larger in diameter than the bolt 5 generally by about 1.5 mm (1/16 inch). The outer flank 11 of the cam washer 4 comprises a spiral cam profile substantially centred at the hole 4*b*. The spiral profile in the example illustrated subtends an angle of approximately 200° about the flank 11. The remainder of the washer flank 11 consists of a first and second planar portions 16 and 17 which are normal to each other. The first planar portion 16 is tangential to the inward curve of the spiral profile to provide a smooth transition as the washer 4 is rotated. The second planar portion 17 advantageously extends along substantially a maximum diameter of the cam 4 on a side of the said hole 4*b* opposite the spiral profile, to provide a face for receiving blows to rotate the washer 4 in a clockwise direction.

In the preferred form, the width of the cam, measured from the hole 4*b* increases substantially monotonically with respect to successive substantially equal angular displacements about the centre of said hole. Although the profile does not conform precisely to a monotonic curve, a monotonic relationship may be mathematically expressed as $$D=D_O+C\phi$$

Wherein $D_O$ is the width of the cam at the origin or inward end of the curve of the profile, C is a constant and $\phi$ is the angle measured between a reference line drawn from the centre of the hole 4*b* to the origin and a line drawn from said centre to the flank of the cam where the width is D.

Preferably, for ease of manufacture of the cam, the cam profile comprises a series of part circular arcs each having its centre of curvature disposed on an imaginary circle concentric with the hole 4*b* in the cam. Advantageously, successive arcs have their centres of curvature progressively and uniformly spaced around the said circle.

Referring to FIG. 5, in one example the cam profile is generated using an imaginary circle 31. Construction lines 32 and 33 are drawn through the centre of the hole 4*b* parallel to and at right angles to face 17 and may be considered x and y axes, respectively. Points $O_1$ to $O_5$ are taken corresponding to intersections of the imaginary circle 31 with vectors which are at −45°, −90°, −135°, −180° and −225° on the polar coordinate system defined by the x and y axes. Arcs with radii $R_1$ to $R_5$ are drawn from $O_1$ to $O_5$, respectively, these radii decreasing substantially monotonically. Merely by way of example, taking the longest diameter of the cam as one unit, the radii and other dimensions may be as shown in Table 1:

TABLE 1

| Dimension | Value (Units) |
|---|---|
| Longest diameter of cam (through $O_1$) | 1 |
| $R_1$ | 0.6875 |
| $R_2$ | 0.6283 |
| $R_3$ | 0.5658 |
| $R_4$ | 0.5033 |
| $R_5$ | 0.4408 |
| Diameter of hole 4b | 0.3701 |
| Diameter of circle 31 | 0.1850 |

These axes generated by the radii $R_1$ to $R_5$ merge together smoothly at their ends to create a smooth spiral profile. As will be appreciated each arc subtends about 45° so that for each 45° rotation there is approximately an equal or monotonic increase in the width of the cam measured from the centre of the hole 4*b*.

Referring to FIGS. 3 and 4, the advantages of such a cam washer 4 may be readily understood. When the flange 1 is to be moved forwardly the relative positions of the clip 3, washer 4 and flange 1 are generally as shown in FIG. 3. When the clip 3 is in its rearwardmost position, the first planar portion 16 abuts the rearward face 12 of the abutment portion 8, and the bolt 5 abuts the forward end of the slot 10. The nut 6 abuts against the cam washer 4 in a loose condition to temporarily hold the washer 4, clip 3 and rail flange 1 in position during the alignment operation. In a loose condition the clip 3 and flange slide upon the supporting surface 2, and the washer 4 slides upon to the clip 3, while held together by the nut 6. To move the flange 1 forwardly, it is slugged with blows from a hammer, usually applied to a tool such as a square drift, the head of which is applied at the second planar portion 17 of the washer 4, thereby rotating the washer 4 clockwise about the bolt 5. As the cam washer 4 rotates clockwise, the spiral profile flank 11 abuts and slides along the rearward face 12 of the clip abutment portion 8 displacing the clip 3 and flange 1 forwardly on the supporting surface. The flange 1 slides forwardly due to the increasing distance between the hole 4*b* in the washer 4 which engages the stationary bolt 5, and the spiral profile flank 11.

The desired location of the rail is determined using known surveying techniques such as the projection of a laser beam along the desired rail centre line for example. The approximately monotonic relationship between angular change and radial dimension change of the spiral profile is advantageously used to estimate the rotation of the washer 4 required to move the clip 3 and flange 1 the desired amount.

For example, the monotonic relationship may be such that for every 45° increase in rotation the radial dimension increases by approximately 5 mm (0.19 inches). Therefore, if the rail must be moved 10 mm, the washer 4 must be rotated 90°, and so on. An advantage of the monotonic relationship therefore, is that throughout the range of movement of the washer 4, one may predict the rotation required to obtain the desired lateral rail adjustment.

A further advantage of the approximately monotonic relationship is that an approximately uniform force is required to rotate the washer 4 shifting the rail, throughout the range of movement One may observe that a hammer blow of a certain approximate magnitude directed on the second planar portion 17 results in a uniform lateral rail movement. This is true regardless of the location of the point of contact between the spiral profile flank 1 and the rearward face 12 of the abutment portion 8, throughout the length of the spiral profile. Therefore, installation and alignment is simplified since the force required and rotation of the washer 4 required to produce a desired lateral movement of the flange 1 are easily and reliably predicted.

Since connectors are arranged in opposing pairs spaced along the length of the flange 1, the flange 1 may be moved laterally toward and away from each row of fixed bolts 5 by rotating the washers 4 of each opposing connector in opposite directions. Referring to FIG. 1, in order to move the flange to the left, the washer 4 of the connector on the left side of the flange 1 must be rotated counterclockwise while the washer 4 of the connector on the right side of the flange 1 must be rotated clockwise.

When the rail flange 1 is in its exact desired location, the nuts 6 of opposing connectors are tightened. The nuts are tightened preferably simultaneously to avoid any undesirable excessive clockwise rotation of the washers 4 under the force of friction between the bottom surface of the nut 6 and the top surface of the washer 4. A slight clockwise rotation of the washer 4 during tightening of the nut 6 may be desirable since as a result the washer 4, clip 3 and flange 1 are forced into close engagement to hold the flange securely. The clip base portion 7 is advantageously cast or formed with a bow in the longitudinal direction convexly upwardly so that it functions like a spring washer when the nut is tightened up, urging the threads of the nut 6 upward into close engagement with the threads of the bolt 5. The resultant resistance to turning of the nut 6 due to friction between the mating threads ensures that the connector remains secure under the vibration and impact of moving machinery upon the rail.

In the clamped condition, the nut 6 is tightened against the cam washer 4. The cam washer 4 bears upon the top surface of the clip base portion 7, and the bottom surface of the clip base portion 7 bears upon the supporting surface. As shown in FIG. 1, the flange 1 is securely retained laterally between the forward surfaces of opposing clip abutment portions 8. The flange 1 is clamped between the supporting surface 2 and the bottom surfaces of the cantilever portions 9 of opposing connectors.

A still further advantage of the preferred form of cam washer 4 is in relation to the opening torque exerted on the nut 6. The opening torque is the torque resulting from a transverse load applied on the flange and transmitted through the abutment portion 8 to the flank 11 of the cam washer 4. When the nut 6 is fully tightened up, the cam washer 4 may be considered locked to or integral with the upper surface of the clip 3 and so there is little force transmitted from the abutment portion 8 to the flank 11 of the cam 4. Any such force, however, is transmitted to the nut 6 in the form of a torque tending to open or loosen the nut 6 and applied along a radius normal to the tangent to the flank 11 at the point of contact between the flank 11 and the rear face of the abutment portion 18. The torque is of course the product of the magnitude of the force and the distance of its line of action from centre, that is to say the perpendicular distance between the radius in question and the axis of the nut (considered to be the centre of the hole **4*b* at the intersection of the axes 32 and 33). One advantage of the preferred form of the cam 4 is that such perpendicular distance will vary only slightly and is substantially constant at all rotational positions of the cam 4 relative to the clip 3. Therefore the nut 6 can be tightened up to a given torque corresponding to the desired maximum transverse load or force exerted by the flange 1, with confidence that the maximum transverse load will be resisted by the clip at all rotational positions of the cam 4**.

Similarly, there is a constant mechanical advantage in slugging or striking against the planar portion 17 in order to rotate the cam 4 during adjustment. The lever arm of the force resisting rotation, namely the force generated against the rail flange 1 and transmitted along the radius from the tangent to the flank 11 at its point of contact with the abutment portion 18 is, of course, the above-mentioned perpendicular distance between such radius and the centre of the hole **4*b*, which distance is substantially constant at all rotational positions of the cam 4. Assuming the slugging blow is normal to the planar portion 17, the lever arm of the force causing rotation is the distance between the point of impact and axis 33, the maximum extent of which is the distance from the axis 33 to the end of the planar portion 17 remote from the planar portion 16**. Desirably, the ratio of the distance between said maximum extent and the above-mentioned perpendicular distance is in the range about 6:1 to 12:1, more preferably about 7:1 to 11:1.

In particularly preferred forms, in order to obtain favourable mechanical advantages, the above-mentioned imaginary circle 31 is smaller than the hole **4*b* in the cam 4. Merely by way of illustration, in one example, the hole 4*b* has a diameter of 0.5625 in., the imaginary circle 3 has a diameter of 0.2812 in., the perpendicular distance of any radius from the centre of the hole 4*b* is substantially 0.0994 in., and the distance between the axis 33 and the end of the planar portion 17** is about 0.8952 in., giving a mechanical advantage of up to about 9:1.

The flanges 1 of rolled structural shapes, such as rails, have edges which are rounded during the rolling process as shown in FIG. 1. When the nut 6 becomes loose, due to vibration for example, especially in the case of rails with relatively thin flanges 1, the flange 1 may shift laterally working its way between the bottom surface of the clip base portion 7 and the supporting surface 2. The rounded edges of such flanges 1 aid in wedging the flange 1 between the clip 3 and supporting surface 2 by offering less resistance than would a sharp edge. To lessen the tendency of the flange 1 to ride under the clip 3, the clip is advantageously manufactured such that the bottom surface of the base portion 7 and the forward surface of the abutment portion merge together at a sharp edge 18. The radius of curvature of the sharp edge 18 is significantly less than the height of the forward face of the abutment portion 8.

The outer face of the flange 1 bears upon the full forward face of the clip abutment portion 8, and the lateral load is transmitted between the rearward face of the abutment portion 8 and the cam 4 to the bolt 5 which offers direct shear resistance. Although the curved spiral profile portion 15 of the cam 4 and the rearward face of the clip abutment portion 8 engage in essentially a line contact, since the amount of load transmitted between them is relatively low, the bearing stress remains within acceptable limits and excessive wearing does not occur in a clamped condition. When the nut 6 is excessively loosened, under vibration for example, the line contact between the cam washer 4 and the abutment portion 8 may result in wearing, flattening or indenting of the cam 4 and this can be corrected by replacement of an inexpensive component, namely the cam 4. There is no tendency for deformation of the abutment portion 8 since this engages the rail flange 1 in full width engagement.

Figure 6:
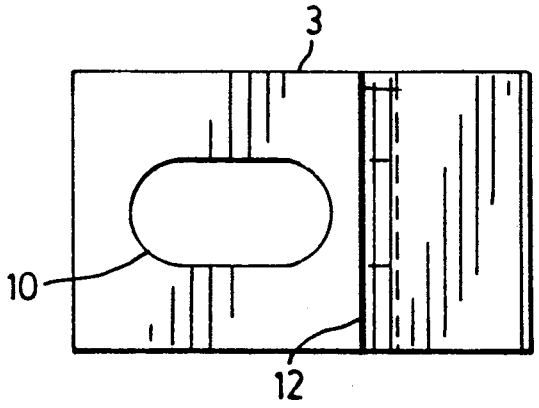
FIGS. 6, 7 and 8 illustrate an alternate clip respectively in plan, elevation and frontal isometric views.
Figure 7:
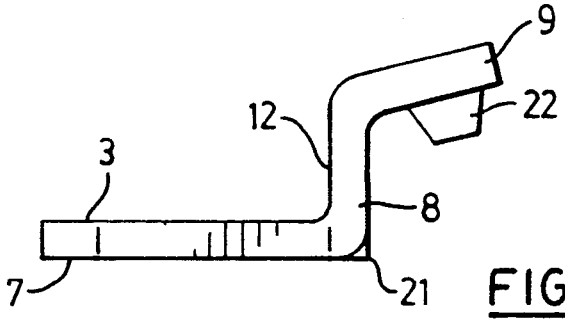
Figure 8:
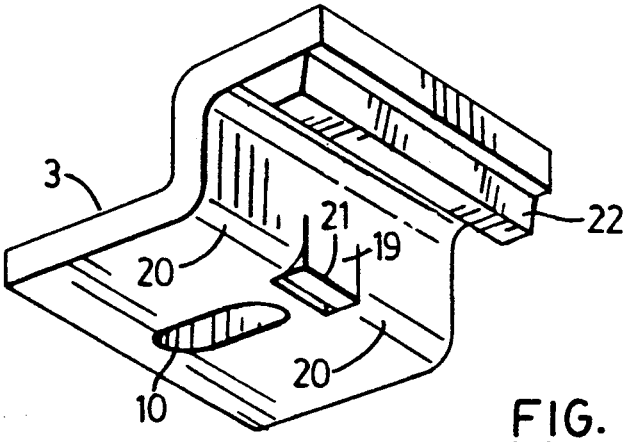

In the manufacture of a connector in accordance with the invention, the cam washer 4 and clip 3 may be stamped from plate metal or may be cast of metal. As described above, it is important to ensure that the clip 3 is manufactured having a base portion 7 bottom surface which merges with the forward face of the abutment portion 8 with a relatively small radius or sharp corner 18. When a clip 3 is stamped from plate metal, it is difficult to form such a very sharp corner 18 since bending of the blank results inevitably in a rounded edge. In most cases therefore, cast clips 3 may be preferred. In FIGS. 6, 7, and 8 is illustrated a variant in which the clip 3 is stamped from plate metal having a central projection 19 and a slot 10 having a forward transverse end in the plane of the abutment rearward face 12. The slot 10 is punched out of a blank having a round rearward end and a transverse forward end. The blank is then bent to form the base portion 7, abutment portion 8 and cantilever portion 9. The edge formed between the bottom surface of the base portion 7 and the forward surface of the abutment portion has outer rounded sections 20 on both sides of the central projection 19. The central projection 19 has a sharp bottom edge 21 which is of sufficient width to inhibit the tendency of the rail flange to ride between the clip 3 and the supporting surface 2. Therefore, the relatively inexpensive stamping process may be used to produce a clip 3 having a sharp bottom edge 21, as an alternative to the casting process.

We claim:

1. A device for aligning and clamping a rail flange upon a planar support surface, comprising:

a clip, having a base portion substantially parallel to said support surface, an abutment portion and a cantilever portion, said base portion having a longitudinal slot, an uppermost surface substantially parallel to said support surface and a bottom surface substantially parallel to said support surface slidably engaging said support surface in a loose condition and bearing upon said support surface in a clamped condition, said abutment portion extending from a forward end of said base portion perpendicular to said support surface, said abutment portion having a forward face for engaging an outer face of said flange, said cantilever portion extending forwardly from said abutment portion, said cantilever portion having a bottom surface engaging an upper surface of said flange;

a cam washer having an eccentrically located hole, said cam washer having a bottom surface slidably engaging said uppermost surface of said base portion when in a loose condition and bearing upon said base portion in a clamped condition, said cam washer having an outer flank for engaging a rearward face of said abutment portion;

connecting means engaging a top surface of said cam washer and extending through said hole and said slot for aligning and bearing upon said cam washer and clip to said support surface and for clamping said flange between said cantilever portion and said support surface;

wherein said flange may be aligned laterally by rotating said cam washer about said connecting means in a loose condition to push said forward face of said abutment portion into said flange.

2. A device according to claim 1, wherein said outer flank of said cam washer comprises a spiral cam profile substantially centered at said hole.

3. A device according to claim 2, wherein the width of the cam increases substantially monotonically with respect to successive substantially equal angular displacements about the centre of said hole.

4. A device according to claim 3 wherein said cam profile comprises a series of part circular arcs each having its centre of curvature disposed on an imaginary circle concentric with the hole in the cam.

5. A device according to claim 4 wherein successive arcs have their centres of curvature progressively and uniformly spaced around said circle.

6. A device according to claim 4 wherein said imaginary circle is smaller than the hole in the cam.

7. A device according to claim 1 wherein said cam has at least one planar side face.

8. A device according to claim 7 wherein said cam has a planar side face extending along substantially a maximum diameter of the cam on a side of said hole opposite said spiral cam profile.

9. A device according to claim 4 wherein the cam has a planar side face on a side of the hole opposite the spiral cam profile extending a perpendicular distance from the centre of the hole in the cam, and the ratio of said perpendicular distance to the perpendicular distance between the radii of curvature of said arcs is in the range about 6:1 to 12:1.

10. A device according to claim 9 wherein said ratio is about 7:1 to 11:1.

11. A device according to claim 2 wherein when oriented with one face uppermost the width of said cam relative to a fixed point increases progressively with rotation of the cam clockwise about said hole, and said one face carries a distinctive mark for indicating proper orienting of the cam.

12. A device according to claim 11 wherein said distinctive mark comprises an arrow indented in said one face and pointing in the direction of clockwise rotation about the hole.

13. A device according to claim 1, wherein the bottom surface of the base portion and the forward surface of the abutment portion merge together with a radius of curvature less than the height of said forward face of said abutment portion.

14. A device according to claim 1, wherein said connecting means comprise a threaded bolt and a mating nut engaging the top surface of said cam washer.

15. A device according to claim 14, wherein said bolt comprises a stud-welded bolt upon a metal supporting surface.

16. A device according to claim 14, wherein said bolt comprises an anchor bolt fixed with respect to said support surface.

17. A device according to claim 14 wherein one of said cam washer and said clip base portion is bowed relative to the other, whereby a resilient reaction is provided between the cam washer and the base portion when the nut is tightened up causing increased friction between the threads of the nut and the bolt.

18. A device according to claim 17 wherein said clip base portion is bowed convexly upwardly.

19. A device according to claim 1, wherein said bottom surface of said cantilever portion includes an elastomeric pad.

* * * * *